US007108248B2

(12) United States Patent
Winter et al.

(10) Patent No.: US 7,108,248 B2
(45) Date of Patent: Sep. 19, 2006

(54) CABLE PULLEY BLOCK HAVING DETACHABLE FASTENING OF A CABLE TO A CABLE DRUM

(75) Inventors: Klaus-Jürgen Winter, Wetter (DE); Heinrich Flaig, Bochum (DE); Jürgen Backsmann, Hagen (DE); Franz Schulte, Herdecke (DE)

(73) Assignee: Demag Cranes & Components GmbH, Wetter (DE)

( * ) Notice: Subject to any disclaimer, the term of this patent is extended or adjusted under 35 U.S.C. 154(b) by 0 days.

(21) Appl. No.: 10/970,914

(22) Filed: Oct. 22, 2004

(65) Prior Publication Data

US 2005/0103921 A1 May 19, 2005

(30) Foreign Application Priority Data

Oct. 30, 2003 (DE) ..... 103 50 942

(51) Int. Cl.
*B66D 1/30* (2006.01)

(52) U.S. Cl. ..... 254/371; 254/372; 242/587.1; 242/587.2; 242/579

(58) Field of Classification Search ..... 254/371, 254/372, 373, DIG. 14; 242/579, 587, 587.1, 242/587.2, 587.3

See application file for complete search history.

(56) References Cited

U.S. PATENT DOCUMENTS

| | | | | |
|---|---|---|---|---|
| 2,124,129 | A * | 7/1938 | Therolf | 254/288 |
| 2,151,837 | A | 3/1939 | Burke | |
| 2,329,943 | A | 9/1943 | Robins | |
| 4,428,099 | A * | 1/1984 | Richmond | 24/68 CD |
| 4,625,947 | A * | 12/1986 | Denman et al. | 254/323 |
| 4,787,602 | A | 11/1988 | Pidgeon | |
| 5,346,153 | A * | 9/1994 | Ebey | 242/579 |
| 5,957,433 | A * | 9/1999 | Fujikawa et al. | 254/371 |
| 6,199,617 | B1 * | 3/2001 | Schweiss | 160/193 |
| 6,732,966 | B1 * | 5/2004 | Wier | 242/376 |
| 6,921,061 | B1 * | 7/2005 | Hayashi et al. | 254/373 |
| 2002/0104918 | A1 * | 8/2002 | Zacharias | 242/587.1 |
| 2003/0010858 | A1 * | 1/2003 | Wier | 242/376 |
| 2003/0085391 | A1 * | 5/2003 | Noske | 254/266 |

FOREIGN PATENT DOCUMENTS

| | | |
|---|---|---|
| DE | 625612 | 1/1936 |
| DE | 625612 | 2/1936 |
| DE | 687945 | 1/1940 |
| DE | 687945 | 2/1940 |
| GB | 121357 | 12/1918 |

OTHER PUBLICATIONS

European Search Report completed Feb. 9, 2005, from corresponding European Application No. EP 04 02 4917.

* cited by examiner

*Primary Examiner*—Emmanuel M Marcelo
(74) *Attorney, Agent, or Firm*—Van Dyke, Gardner, Linn & Burkhart, LLP

(57) ABSTRACT

The invention concerns a detachable fastening of a cable (2) on a cable drum (1), especially a wire cable, with an opening (1*a*) arranged in the cable drum (1), with an enlarged cable end (2*a*) on the cable (2) and a connection piece (4), by which the cable (2) with its end thickening (2*a*) is detachably secured to the cable drum (1) in the region of the continuous opening (1*a*). The connection piece (4) may be detachably secured in the continuous opening (1*a*) and the enlarged cable end (2*a*) be detachably secured to the connection piece (4).

24 Claims, 6 Drawing Sheets

CABLE PULLEY BLOCK HAVING DETACHABLE FASTENING OF A CABLE TO A CABLE DRUM

BACKGROUND OF THE INVENTION

The invention concerns a cable pulley block and, in particular, a technique for detachable fastening of a cable to a cable drum, especially a wire cable.

Cable fastenings to winding drums or cable drums of a hoisting mechanism are machine elements with very high quality demands for safety considerations; their design is regulated in various standards, such as DIN 15020 and EN 14492-2. At the lowest position of a carrying device, there must still be at least two cable turns on the winding drum, and the cable end fastening on the winding drum must be constructed so that, allowing for the friction of the turns remaining on the winding drum, 2.5 times the cable traction force can be sustained, given a coefficient of friction of $\mu=0.1$ between wire cable and base. Guidelines and dimensions for the fastening are set forth, for example, in the Stahl-Eisen-Betriebsblatt (SEB) 666211. The cable ends here are usually incandescently cut or wound with wire.

It is known to provide the cable end with a press-on thickening, usually cylindrical end sleeves of various materials, which, at the same time, make it easy to introduce the end into a continuous opening essentially passing transverse through the wall of the drum into the inside of the winding drum, where the cable end with its thickening is accommodated in a recess cast into the cable drum, made from a casting material, and removably secured as needed. Such a solution is specified, for example, in German Patent DE 101 07 390 C1.

The press-on thickenings of cable ends, also known as press sleeves, can withstand greater cable tractive forces on the drum than the most often used cable clamps with screw fastening per SEB 666211 for the same space required. Because fewer fastening turns are required than with screw clamps, the press sleeves allow for generally shorter drum lengths for the same usable cable length, which besides saving costs also allows a more favorable utilization of space. Moreover, the installation cost when using press sleeves to mount the end of the cable on the cable drum is considerably reduced compared to the solution with a screw clamp. Another benefit of the press sleeve is the fact that one can recognize a proper form-fitted installation from afar and the risk of improperly tightened screws, not permanently secured because wrongly set, is ruled out.

The cable end fastening familiar from German Patent DE 101 07 390 C1 proposes casting specially shaped pockets in the periphery of the drum tube, which accommodate the press sleeves. However, this assumes that the drum tube is made as a cast piece, which is not always the case today. Quite often, not least for cost reasons, cable drums are made from seamless rolled tubes or round rolled plates with a longitudinal welded seam. On such cable drums, a fastening of press sleeves in the manner described above is not possible.

The same holds for a solution as described by U.S. Pat. No. 2,329,943 and which, likewise, uses a cast cable drum. In the case of the cable end fastening specified therein, the press sleeve placed on the cable end after being inserted through the continuous opening is held by a connection piece, which is screwed into a cast-on recess of the cable drum in the region of the intended continuous opening for the end of the cable. The connection piece closes the continuous opening enough to block and retain the thickening of the cable end on the inside of the winding drum. The connection piece and winding drum are intricately manufactured shaped parts adapted to each other, and while it is possible to loosen the fastening of the cable end from the drum with them, their manufacture and use is costly and time-consuming.

DE 625 612 discloses a device for fastening a cable end to a cable drum, in which a roughly C-shaped cable hook is inserted into a keyhole-shaped slot in the cable drum and secured in the slot by a 180° twist. The cable is inserted into the cable hook by means of a grommet thimble.

DE 687 945 discloses the fastening of a cable in a holder screwed to the cable drum by means of an enlarged cable end.

SUMMARY OF THE INVENTION

Starting with a detachable cable end fastening of the above-described type, the present invention creates a cable end fastening that is quickly detachable with slight expense. It may also be possible to use this cable end fastening on noncast winding drums made from seamless or longitudinally welded tubes, without sacrificing the advantages of the known fastening systems for cable ends on cast winding drums. It may also be possible to fasten the cable ends to noncast winding drum tubes when the drums are closed at their end faces or otherwise have an inaccessible interior.

In the case of a detachable fastening of a cable to a cable drum, especially a wire cable, with an opening arranged in the cable drum, with an enlarged cable end on the cable and a connection piece by which the cable is removably fastened by its enlarged end to the cable drum in the region of the opening, it is proposed that the connection piece be removably fastened in the opening and the enlarged cable end be removably fastened to the connection piece. In this way, a secure cable end fastening is accomplished with only one structural part in the form of the connection piece.

Contrary to the state of the art, in which the cable end has to be introduced into the continuous opening of the drum, the connection piece of the invention protrudes outward from the continuous opening far enough so that the thickened end of the wire cable can be received and held there. The connection piece is preferably configured so that it can be inserted as a separate piece from the outside into the continuous opening in the drum-shaped winding drum when the end faces of the cable drum tube are closed by other parts, such as the frame.

An especially simple construction and safe function of the cable end connection is achieved in that the connection piece is locked in the continuous opening by the enlarged cable end fastened to the connection piece.

In order to fasten the end of the cable, according to another aspect of the invention, the connection piece is provided with a borehole in its outwardly protruding region, running approximately tangential to the winding drum, through which the cable can be passed, and which can fasten the end thickening of the cable with form fitting in the lengthwise direction of the cable.

According to another aspect of the invention, it is proposed that the borehole be stepped and have a ring-shaped bearing surface, against which the end face of the enlarged cable end lies with form fitting.

According to another aspect of the invention, the borehole may be outwardly slotted in its lengthwise dimension at a width corresponding to the cable diameter, and the cable can be inserted from the outside into the forklike slotted borehole. This makes it possible to insert the enlarged cable end directly into the receiving borehole, without having to pass the entire cable through the receiving borehole in its full length.

According to another aspect of the invention, it is proposed that the dimensions of connection piece and continuous opening be attuned to each other so that the connection piece can be inserted from the outside into the continuous opening and be held inside the cable drum in a form-fitting manner at the side of the opening. Such form-fitted holding from behind should safely prevent a spontaneous loosening of this fastening element from the continuous opening of the drum tube.

In order to achieve this, according to a more specific aspect of the invention, it is proposed that the connection piece be provided with at least one radially extending projection on its region engaging with the continuous opening on the inside, which can pass through the continuous opening when the connection piece is placed at a slant relative to the lengthwise axis of the opening and which prevents the connection piece from being pulled out during use by thrusting against the inner wall of the winding drum.

This type of fastening enables a quick loosening of the connection piece from the drum, without having to loosen screws, and an equally fast securing of the connection piece to the drum from its outer side, i.e., without the drum having to be accessible on the inside. Even so, the connection of the end of the cable and the drum by the connection piece is extremely strong and reliable, even when using winding drums made from steel tubes.

A favorable securing is achieved if, according to an aspect of the invention, two opposite projections of the connection piece engage the opening from behind, so that after the connection piece is introduced into the opening, they lie against the inner wall of the drum on either side of the opening.

The enlarged cable end can be formed in a conventional manner, according to an aspect of the invention, by a press sleeve arranged on the end of the cable. These press sleeves are familiar with respect to their design and placement on the end of the cable, so that they need not be further discussed here.

The press sleeves used may be dimensioned such as to withstand at least 85% of the minimum breaking force of the wire cable. In this way, the tractive force which the cable can support is so large that it is not required to reduce the tractive force by friction against the drum tube, according to the current design rules for such cable end fastenings. This means that the number of fastening turns at the end of the drum can be limited to two turns, in order to meet the requirements. The two turns provide additional safety with regard to the cable tractive force handled by this end fastening.

In addition, according to an aspect of the invention, the thickened end of the cable can be protected from slipping out of the borehole of the connection piece in that a clamping sleeve can be placed on the cable at the side of the connection piece opposite the thickened end of the cable, whose outer diameter is larger than the inner diameter of the borehole. After the thickened end of the cable or the press sleeve has been inserted into the widened receiving borehole of the connection piece, this clamping sleeve is slid on the cable flush against the connection piece and preferably force-fitted there. The fastening is done, for example, by crimping with conventional pliers, which secures the end of the cable form-fitting in its position in the connection piece.

Before replacing the wire cable when damaged, one must first break or forcefully shift the clamping ring. Only then can the end of the cable with the press sleeve be taken out from the connection piece. Therefore, the cables used come with the press sleeve, as well as the clamping ring, loosely placed on them, and it is slid across the end of the cable in the same work step prior to crimping the press sleeve.

Another way to secure the connection piece by an alternative embodiment of the invention is achieved by shoving a bent bracket with an eyelet for the cable onto the cable so that, when the connection piece is in the installation position, one leg of the bracket lies transverse to the cable between the thickened end of the cable and the connection piece, and the other bent leg of the bracket engages transversely with the continuous opening, and with its end face thrusting against the inside of the opening, it prevents a prying out of the connection piece. The bracket is preferably pushed onto the cable prior to crimping the press sleeve and if desired after the clamping sleeve is pushed onto the cable, and it is pressed with the thickened end against the connection piece, where it is held by the clamping sleeve pressed from the other side against the connection piece.

The invention, at minimal expense, creates a quickly removable cable end fastening, even on winding drums made from seamless or lengthwise welded tubes. In the wall of these tubes, one need only make a continuous borehole to receive the connection piece, a borehole requiring minimum expense as compared to a costly cast piece. The fastening of the ends of the cable to the outwardly protruding connection piece is then possible even if the winding drum is closed at its end faces or has its inside inaccessible for other reasons.

These and other objects, advantages and features of this invention will become apparent upon review of the following specification in conjunction with the drawings.

DESCRIPTION OF THE PREFERRED EMBODIMENT

Figure 1:
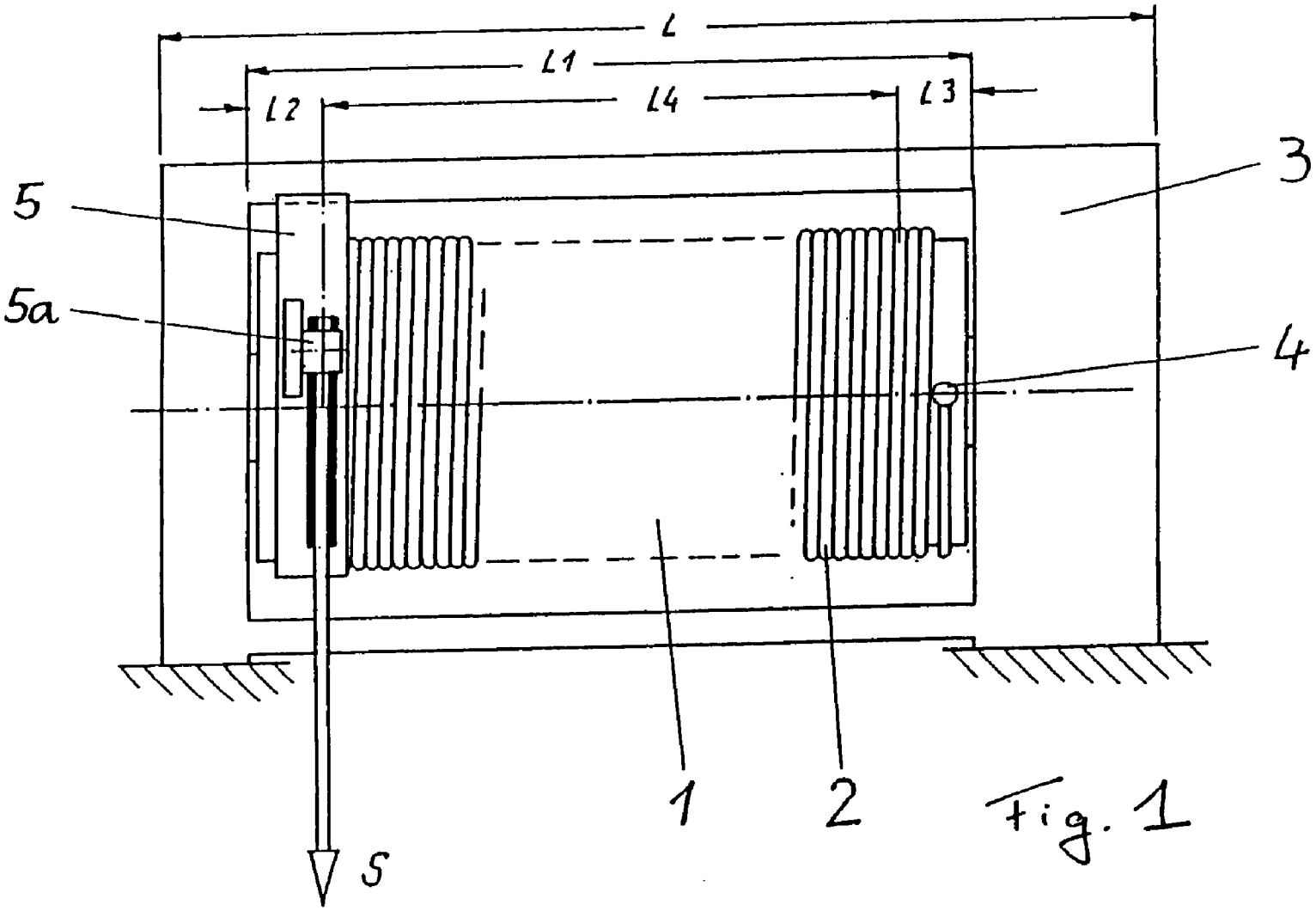
FIG. 1 is a side elevation of a cable pulley block with a cable drum and a cable end fastening, according to the invention.

Referring now specifically to the drawings and the illustrated embodiments depicted therein, FIG. 1 shows a cable pulley block with a cable drum 1 or winding drum. Wound on the cable drum 1 is a cable 2, preferably a wire cable, which is subjected to a tractive force S, resulting for example from a load being lifted. The cable drum 1 is pivoted in a housing 3 at both of its opposite ends. At one lengthwise end of the cable drum 1, the end of the cable 2 is secured to the cable drum 1 via a connection piece 4.

Furthermore, a cable guide ring 5 with a pressure roller 5*a* is provided, arranged concentrically to the cable drum 1 and wandering along the lengthwise axis of the cable drum 1 together with the point of departure of the cable 2 from the drum 1 as a result of the winding and unwinding of the cable 2, preventing the cable 2 from shifting in the peripheral direction onto the cable drum 1 when the cable 2 is not loaded (slack).

The overall length L of the cable pulley block is usually designed as small as possible and is dictated by the drum length L1, which is composed of the usable length L4, the dead length L2 at the highest position of the load, and the dead length L3 at the lowest position of the load.

Figure 2:
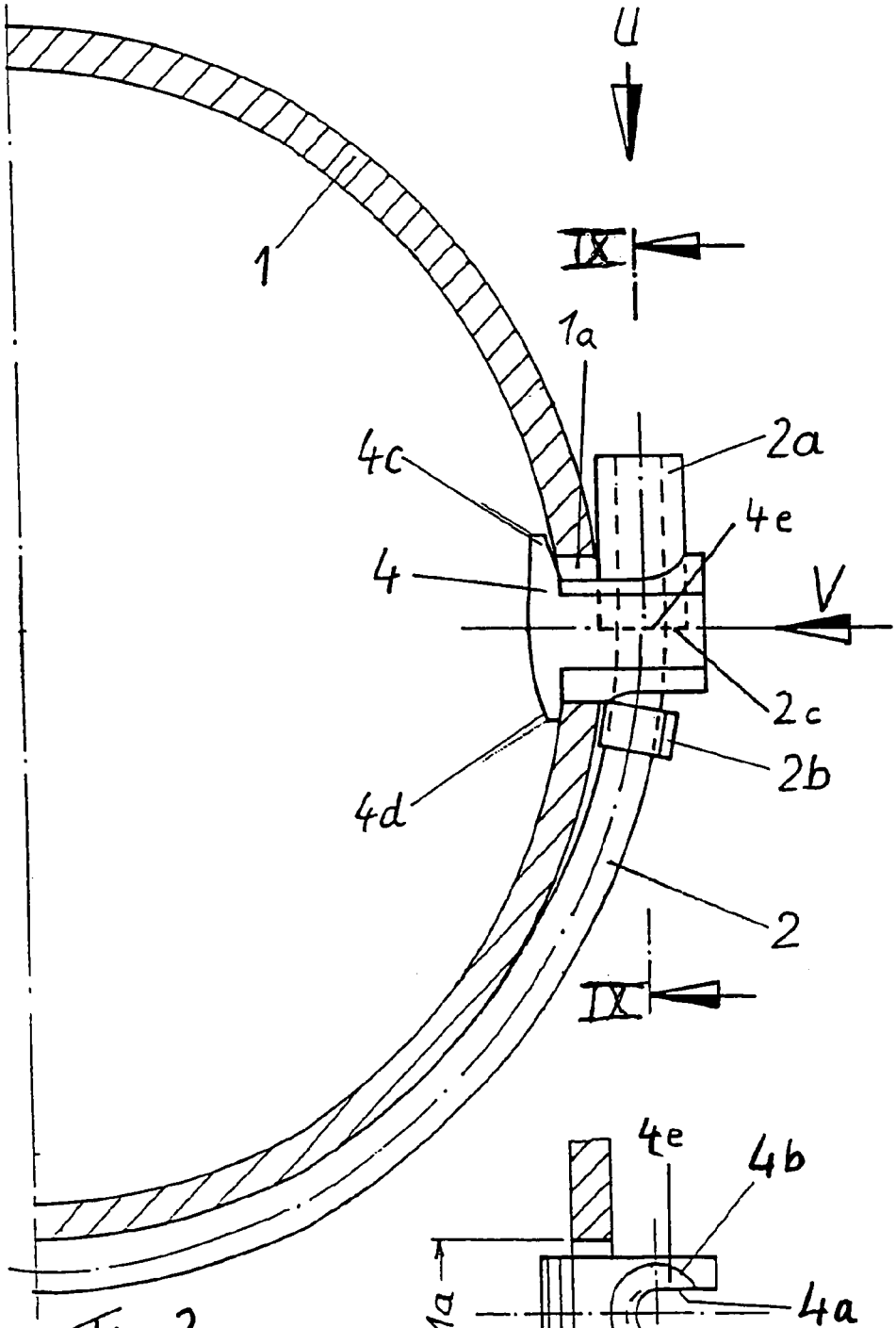
FIG. 2 is a half section view taken through the cable drum of FIG. 1.

FIG. 2 shows a half section through the cable drum 1 at the height of the cable end fastening with the connection piece 4 in operating position. The connection piece 4 is inserted into a continuous opening 1*a* in the cable drum 1 and has the purpose of, first, accommodating the end of the cable 2 with an end thickening 2*a* and, secondly, to engage preferably in form-fitting manner with the cable drum 1 in order to transmit the cable forces. The connection piece 4, essentially shaped as a hammer head bolt, is provided in its head region with two opposite and radially extending projections 4*c* and 4*d*, which in the operating position with the connection piece 4 inserted into the continuous opening 1*a* in the cable drum 1 engage the inner edges of the continuous opening 1*a* and thus find a form-fitted purchase in the continuous opening 1*a*. The projections 4*c* and 4*d* as well as the continuous opening 1*a* are dimensioned such that the projections 4*c* and 4*d* can pass through the continuous opening 1*a* when the connection piece 4 is slanted relative to the lengthwise axis of the continuous opening 1*a* (see FIGS. 6*a* to 6*e*), yet they prevent the connection piece 4 from being pulled out of the continuous opening 1*a* in the working position. In the working position, the lengthwise axis of the connection piece 4 is pointed radially to the cable drum 1 or coaxially to the axis of the continuous opening 1*a*.

The end of the cable 2 is fastened to the region of the connection piece 4 projecting outward from the continuous opening 1*a* of the cable drum 1 in the working position. For this, on the one hand, an enlarged cable end 2*a* in the form of a press sleeve is arranged at the end of the wire cable 2 and, on the other hand, a borehole 4*b* running tangentially to the cable drum 1 when the connection piece 4 is in the working position is provided in the projecting region of the connection piece 4. The borehole 4*b* has a step shape in its lengthwise direction and starts at the bottom with a diameter roughly corresponding to the diameter of the cable 2, then widens in step fashion to a diameter roughly corresponding to the outer diameter of the press sleeve of the enlarged cable end 2*a*. The step-like widening of the diameter creates a ring-shaped bearing surface 4*e* for a corresponding end face 2*c* of the essentially cylindrical enlarged cable end 2*a*, by which the cable forces S are then transmitted to the connection piece 4.

Figure 3:
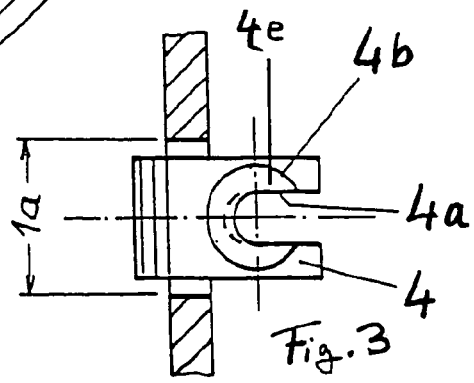
FIG. 3 is a top plan view taken from the direction U of a connection piece of the cable end fastening in FIG. 2.

Furthermore, one notices in FIG. 3, which shows a view from above looking at the connection piece 4 of FIG. 2, that a slot 4*a* open at the top adjoins the two diameter regions of the borehole 4*b* at the side. This slot 4*a* is open away from the projections 4*c* and 4*d* of the connection piece 4. The width of the slot 4*a* corresponds roughly to the diameter of the cable 2, so that the cable 2 does not have to be threaded through the borehole 4*b* in order to install the cable end fastening, but instead it can be shoved at the side through the slot 4*a* into the connection piece 4. Then, to bring the enlarged cable end 2*a* up against the bearing surface 4*e* of the borehole 4*b* with its end face 2*c*, the cable 2 is pulled through the borehole 4*b*.

A clamping sleeve 2*b* has been press-fitted on the cable 2 at the side of the connection piece 4 opposite the press sleeve 2*a*, thus preventing the press sleeve 2*a* from being lifted out from the receiving borehole 4*b*.

Figures 4, 5:
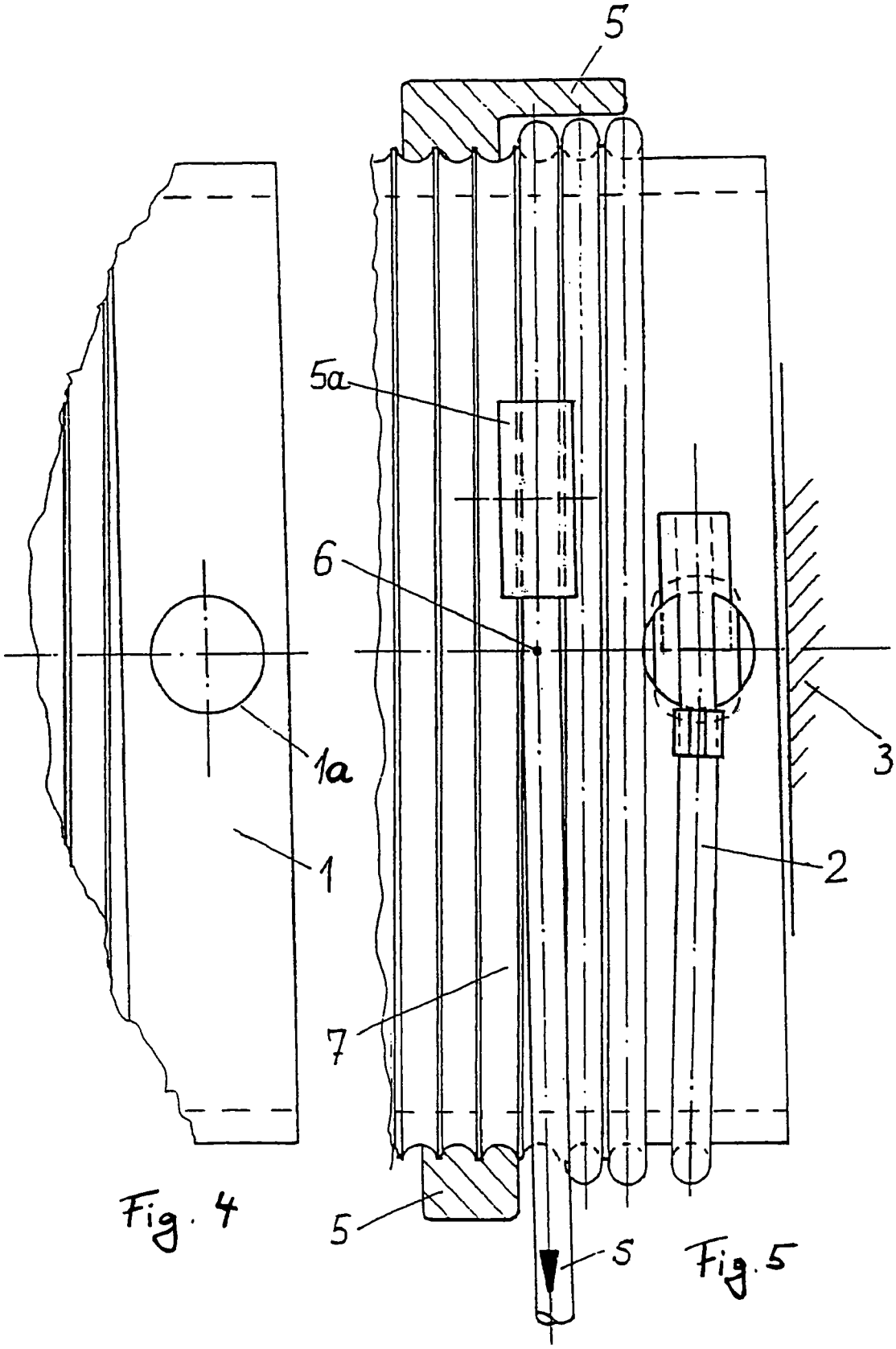
FIG. 4 is a side elevation of the connection piece in FIG. 3 illustrated without the cable.
FIG. 5 is the same view as FIG. 4 illustrated with the cable.
Figures 6A, 6B, 6C, 6D, 6E:
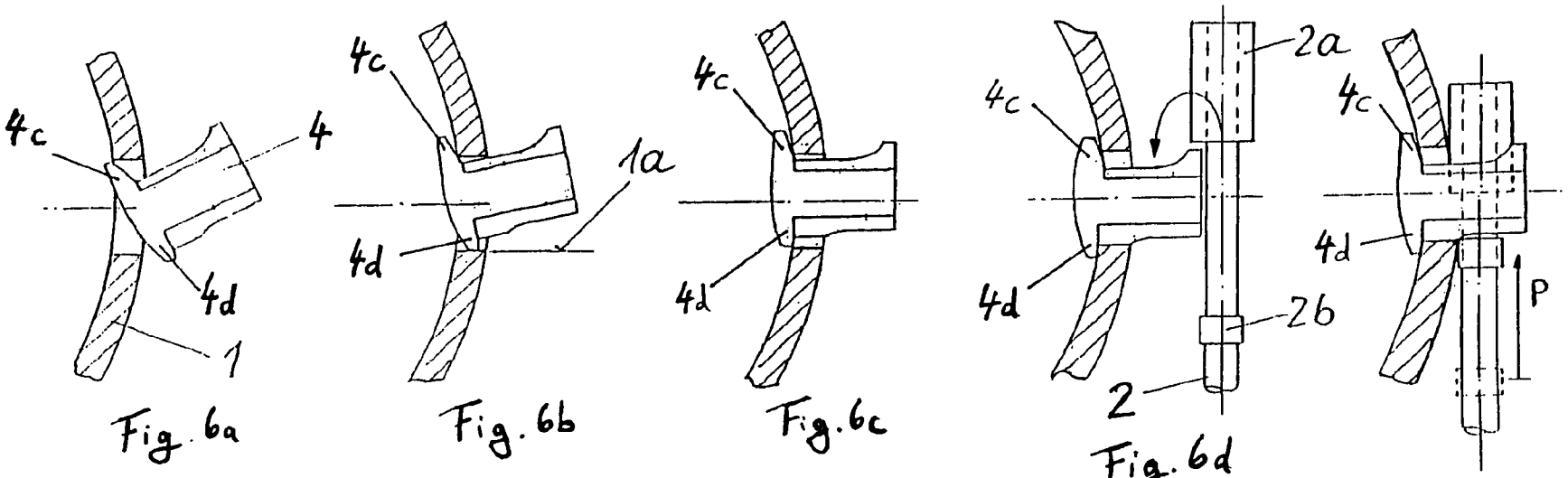
FIGS. 6*a*–6*e* illustrate the installation process for the connection piece in the cable drum tube.

FIG. 4 shows an end segment of the cable drum 1 without cable 2 from the region of the continuous opening 1*a*. It can be seen that the continuous opening 1*a* is configured as a cylindrical borehole.

FIG. 5 shows an end segment corresponding to that of FIG. 4, but together with the cable 2 and the cable guide 5. The cable guide 5 has a spring-loaded pressure roller 5*a* in the vicinity of the cable departure point 6, which presses radially on the cable 2 and presses the cable 2 into the cable groove 7 of the cable drum 1. The turns of the cable end fastening are situated between the connection piece 4 and the cable departure point 6, within which the cable tractive force S is counterbalanced by friction in the cable groove 7 according to the Eytelwein equation. In this way, the residual cable tractive force remaining at the connection piece 4 is only a fraction of the original force S.

FIG. 5 also shows a portion of the frame 3, preventing access to the inside of the cable drum 1. This shows the necessity of configuring the connection piece 4 so that it can be introduced into the continuous opening 1*a* from the outside.

The introducing of the connection piece 4 into the continuous opening 1*a* is represented in FIGS. 6*a* to 6*e* in individual steps in the sequence of the installation process. As can be seen, the connection piece 4 is at first tilted upward by its lengthwise axis relative to the lengthwise axis of the continuous opening 1*a*, in order to insert the upper radial projection 4*c* of the connection piece 4 through the continuous opening 1*a* (see FIG. 6*a*). Next, the lower radial projection 4*d* also passes through the continuous opening 1*a* (see FIG. 6*b*). After the radial projections 4*c* and 4*d* have passed through the continuous opening 1*a*, the connection piece 4 is swung back in the direction of the axis of the continuous opening 1*a*, so that the projections 4*c* and 4*d* lie against the wall of the cable drum 1 on the inside (see FIG. 6*c*). In the next step (see FIG. 6*d*), the cable 2 is inserted from the side through the slot 4*a* (see FIG. 3) in the connection piece 4 and then the press sleeve 2*a* is pulled from underneath into the widening of the borehole 4*b*, running approximately tangentially to the cable drum 1. In order to fix the press sleeve 2*a* in this position, the clamping sleeve 2*b* previously slid onto the cable 2 (see FIG. 6*e*) is slid up from the bottom against the connection piece 4, as shown by the arrow P in FIG. 6*e*, and crimped there with conventional pliers. In this way, the connection piece 4 and the wire cable 2 are then secured in this position.

Figure 7A:
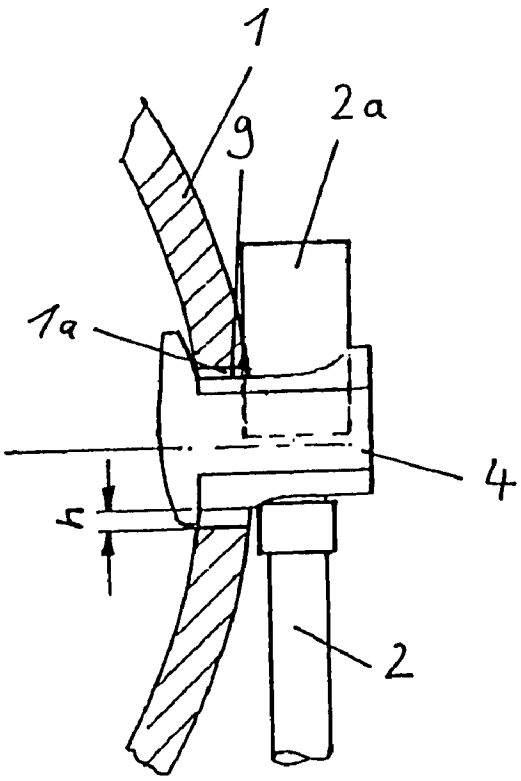
FIGS. 7*a*–7*c* illustrate an enlarged detail of FIG. 2 at the region of the connection piece.
Figure 7B:
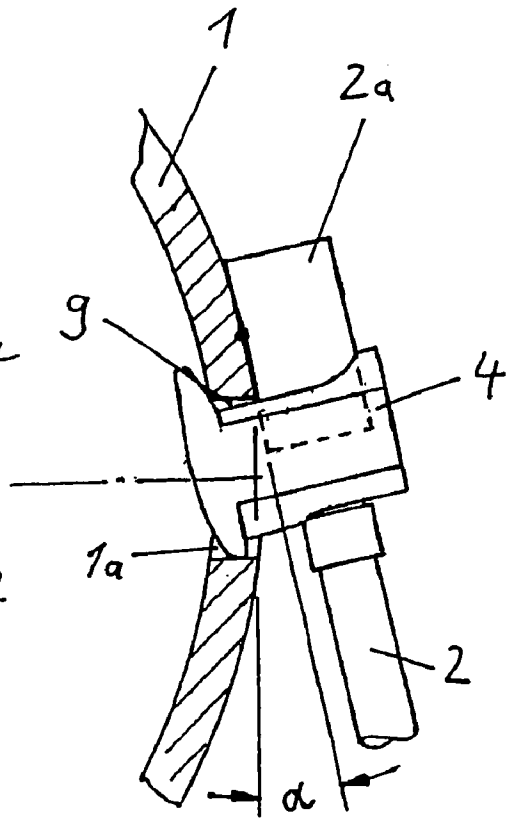
Figure 7C:
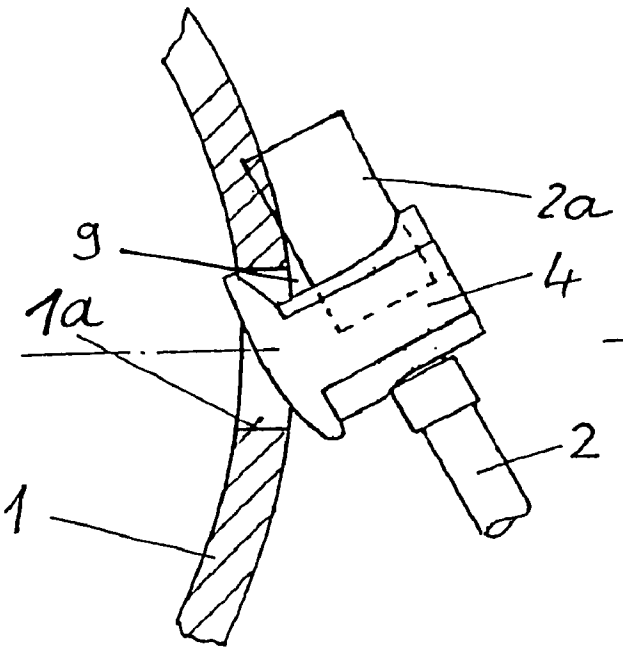

FIGS. 7*a* to 7*c* each show an enlarged detail of the region of the connection piece 4 from FIG. 2. These figures show that, by the choice of the dimensions of the connection piece 4, the opening 1*a* and the enlarged cable end 2*a* relative to each other, the connection piece 4 will be effectively prevented from being pried out from the borehole 1*a* in the cable drum 1, even if the cable guide 5 were not present and even when the cable 2 is slack.

In FIG. 7*a*, one notices that the enlarged cable end 2*a* inserted into the wide part of the borehole 4*b* of the connection piece 4 acts like a bolt to prevent a loosening of the connection piece 4 from the continuous borehole 1*a*. The side of the enlarged cable end 2*a* facing the cable drum 1, together with the connection piece 4, especially its upper radial projection 4*c*, encloses the inner margin of the continuous borehole 1*a* in U-shaped fashion. Since the upper radial projection 4*c* tapers upward, the receiving gap 9 for the inner margin of the continuous borehole 1*a* bounded by the enlarged cable end 2*a* and the upper radial projection 4*c* also widens accordingly. The width of the gap 9 at its base is less than the thickness of the cable drum 1 and widens upward beyond the thickness of the cable drum 1. Thus, when the cable connection 2*a* is inserted, the connection piece 4 can only be shoved upward by a slight distance h in the circumferential direction of the cable drum 1, so that the lower radial projection 4*d* cannot go out from the continuous borehole 1*a*.

If, contrary to expectation, the lower radial projection 4*d* should get beyond the inner margin of the continuous borehole 1*a* into the continuous borehole 1*a*, as shown in FIG. 7*b*, the connection piece 4 has already been shifted slightly upward. A further shifting of the connection piece 4, which is necessary in order to leave the continuous borehole 1*a*, is prevented however by the enlarged cable end 2*a* remaining in the borehole 4*b*. Any shifting of the connection piece 4 is limited to an angle α by a contact between the enlarged cable end 2*a* facing the cable drum 1 and the outside of the cable drum 1, which is so small that any further prying of the connection piece 4 out from the continuous opening 1*a* is impossible.

Figure 8B:
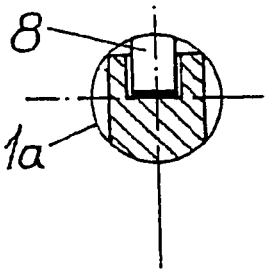
FIGS. 8*a*–8*d* illustrate various detail views of a connection piece according to an alternative embodiment.
Figure 8D:
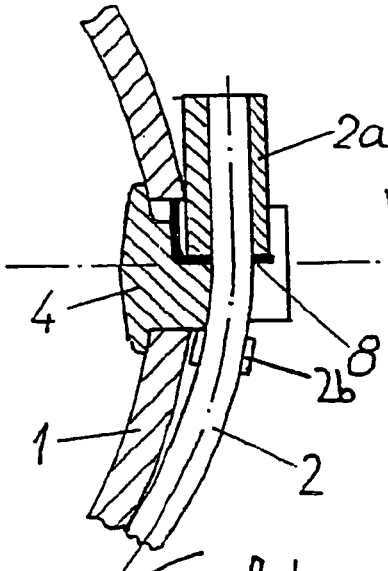
Figure 8A:
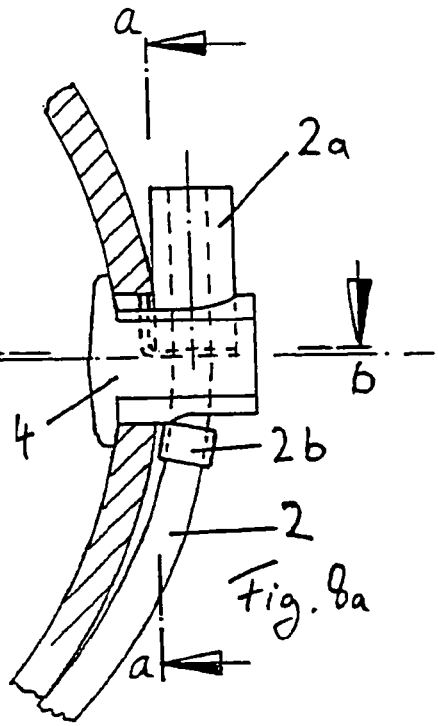
Figure 9:
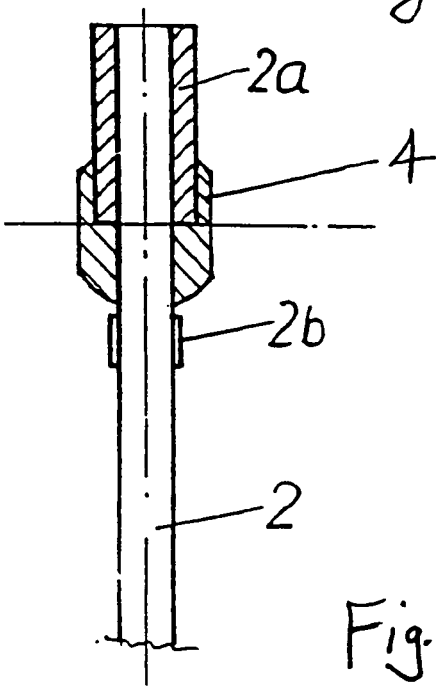
FIG. 9 is a sectional view taken along the lines IX—IX in FIG. 2.
Figure 8C:
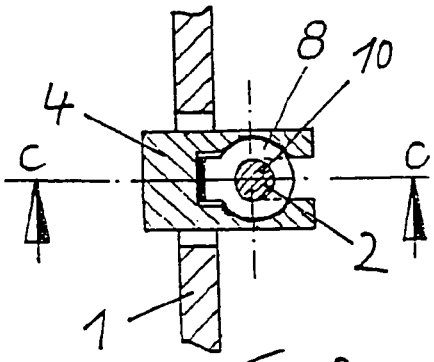

FIGS. 8*a* to 8*d* show various detail views of a connection piece 4 in an alternative embodiment. Here, as opposed to the connection piece 4 shown in the previous figures, a prying of the connection piece 4 out from the continuous opening 1*a* is prevented by using a bracket 8. This bracket 8 can also be used in addition to the foregoing. The bracket 8 is shaped so that it lies against the upper inner edge of the continuous borehole 1*a* and thereby prevents the connection piece 4 from being shifted upward in the circumferential direction of the drum tube of the cable drum 1 (see FIGS. 8*a* and 8*d*). The bracket 8 is formed as an angle piece, as is clearly recognized in FIG. 8*d*, which shows a sectional view of FIG. 8*c* along line c—c. One of the two angled sides of the bracket 8 is provided with an eye 10, which was shoved onto the wire cable 2 before pressing on the press sleeve 2*a*. After the connection piece 4 is inserted into the continuous opening 1*a* in the manner represented by FIGS. 6*a* to 6*e*, the wire cable 2 with the press sleeve 2*a* fitted on is pulled back into the borehole 4*b* in the connection piece 4, whereupon the bracket 8 is inserted into the continuous opening 1*a* by its upwardly bent leg, as can be seen in FIG. 8*d*, and secures the connection piece 4 against falling out. The function of the bracket 8 is further illustrated by the additional section views a—a (see FIG. 8*b*) and b—b (see FIG. 8*c*).

Changes and modifications in the specifically described embodiments can be carried out without departing from the principles of the invention which is intended to be limited only by the scope of the appended claims, as interpreted according to the principles of patent law including the doctrine of equivalents.

The embodiments of the invention in which an exclusive property or privilege is claimed are defined as follows:

1. A cable pulley block including a cable drum having a hollow center and cable detachably fastened to said cable drum, said cable pulley block comprising:

an opening extending through a wall of said cable drum into said hollow center, an enlarged cable end on the cable and a connection piece, said connection piece detachably securing said enlarged cable end to the cable drum, wherein said connection piece is detachably secured in said opening and said enlarged cable end is detachably secured to said connection piece.

2. The cable pulley block of claim 1, wherein said connection piece is inserted from the outside into said opening and held form-fitted in said opening, a portion of said connection piece protruding outside of said opening and said enlarged cable end form-fitted to the protruding portion of the connection piece.

3. The cable pulley block of claim 2, wherein said connection piece is locked in said opening by said enlarged cable end fastened to said connection piece.

4. The cable pulley block of claim 3, wherein said connection piece includes a borehole running generally tangential to said cable drum in a protruding region, said cable extending through said borehole and said enlarged cable end of said cable retained at said borehole by form fitting in the cable lengthwise direction.

5. The cable pulley block of claim 4, said borehole being a step shape and having an annular bearing surface, said enlarged cable end including an end face bearing against said step shape with form fitting.

6. The cable pulley block of claim 4, wherein said borehole includes a slot along its lengthwise dimension, said slot having a width corresponding to the diameter of said cable, wherein said cable is inserted from the outside into said slot of said borehole.

7. The cable pulley block of claim 6, wherein said connection piece and said opening are configured to each other so that said connection piece is inserted into said opening from the outside and is held form-fitted in said opening inside said cable drum.

8. The cable pulley block of claim 7, wherein said connection piece is provided with at least one sideways and radially extending projection on its region reaching into the inside of said opening, wherein said projection passes through said opening when said connection piece is slanted relative to a lengthwise axis of said opening and which blocks said connection piece from being pulled out of said opening when said connection piece is in a working position, in which a lengthwise direction of said connection piece is pointing radially in relation to said cable drum.

9. The cable pulley block of claim 8, including two opposite projections engaging said opening from an inner wall of the cable drum, so that said two opposite projections lie against said inner wall on either side of said opening.

10. The cable pulley block of claim 9, wherein said enlarged cable end of said cable is formed by a press sleeve arranged on the end of said cable.

11. The cable pulley block of claim 10, wherein said enlarged cable end of said cable is protected against sliding out from said borehole of said connection piece with a clamping sleeve on said cable at a side of said connection piece opposite said enlarged end of said cable, said clamping sleeve having an outer diameter that is greater than an inner diameter of said borehole.

12. The cable pulley block of claim 11, including an angled bracket having an eye for said cable, said bracket being shoved onto said cable so that, in a working position of said connection piece, one leg of said bracket is positioned between the enlarged cable end and said connection piece, transverse to said cable, and another angled leg of said bracket engages said opening transversely to said opening and prevents said connection piece from being pried out by having its end face thrust against the inside of said continuous opening.

13. The cable pulley block of claim 11 wherein said clamping sleeve is pressed on said cable.

14. The cable pulley block of claim 2, wherein said connection piece includes a borehole running generally tangential to said cable drum in a protruding region, said cable extending through said borehole and said enlarged cable end of said cable retained at said borehole by form fitting in the cable lengthwise direction.

15. The cable pulley block of claim 1, wherein said connection piece is locked in said opening by said enlarged cable end fastened to said connection piece.

16. The cable pulley block of claim 1, wherein said connection piece and said opening are configured to each other so that said connection piece is inserted into said opening from the outside and is held form-fitted in said opening inside said cable drum.

17. A cable pulley block including a cable drum and cable detachably fastened to said cable drum, said cable pulley block comprising:

an opening in the cable drum, an enlarged cable end on the cable and a connection piece, said connection piece detachably securing said enlarged cable end to the cable drum, wherein said connection piece is detachably secured in said opening and said enlarged cable end is detachably secured to said connection piece, wherein said connection piece includes a borehole running generally tangential to said cable drum in a protruding region, said cable extending through said borehole and said enlarged cable end of said cable retained at said borehole, said borehole being a step shape and having an annular bearing surface, said enlarged cable end including an end face bearing against said step shape with form fitting.

18. The cable pulley block of claim 17, wherein said borehole includes a slot along its lengthwise dimension, said slot having a width corresponding to the diameter of said cable, wherein said cable is inserted from the outside into said slot of said borehole.

19. A cable pulley block including a cable drum and cable detachably fastened to said cable drum, said cable pulley block comprising:

an opening in the cable drum, an enlarged cable end on the cable and a connection piece, said connection piece detachably securing said enlarged cable end to the cable drum, wherein said connection piece is detachably secured in said opening and said enlarged cable end is detachably secured to said connection piece, wherein said connection piece is provided with at least one sideways and radially extending projection on its region reaching into the inside of said opening, wherein said projection passes through said opening when said connection piece is slanted relative to a lengthwise axis of said opening and which blocks said connection piece from being pulled out of said opening when said connection piece is in a working position, in which a lengthwise direction of said connection piece is pointing radially in relation to said cable drum.

20. The cable pulley block of claim 19, including two opposite projections engaging said opening from an inner wall of the cable drum, so that said two opposite projections lie against said inner wall on either side of said opening.

21. A cable pulley block including a cable drum and cable detachably fastened to said cable drum, said cable pulley block comprising:

an opening in the cable drum, an enlarged cable end on the cable and a connection piece, said connection piece detachably securing said enlarged cable end to the cable drum, wherein said connection piece is detachably secured in said opening and said enlarged cable end is detachably secured to said connection piece, wherein said enlarged cable end of said cable is formed by a press sleeve arranged on the end of said cable.

22. A cable pulley block including a cable drum and cable detachably fastened to said cable drum, said cable pulley block comprising:

an opening in the cable drum, an enlarged cable end on the cable and a connection piece, said connection piece detachably securing said enlarged cable end to the cable drum, wherein said connection piece is detachably secured in said opening and said enlarged cable end is detachably secured to said connection piece, wherein said connection piece includes a borehole running generally tangential to said cable drum in a protruding region, said cable extending through said borehole and said enlarged cable end of said cable retained at said borehole, wherein said enlarged cable end of said cable is protected against sliding out from said borehole of said connection piece with a clamping sleeve on said cable at a side of said connection piece opposite said enlarged end of said cable, said clamping sleeve having an outer diameter that is greater than an inner diameter of said borehole.

23. The cable pulley block of claim 22 wherein said clamping sleeve is pressed on said cable.

24. A cable pulley block including a cable drum and cable detachably fastened to said cable drum, said cable pulley block comprising:

an opening in the cable drum, an enlarged cable end on the cable and a connection piece, said connection piece detachably securing said enlarged cable end to the cable drum, wherein said connection piece is detachably secured in said opening and said enlarged cable end is detachably secured to said connection piece, including an angled bracket having an eye for said cable, said bracket being shoved onto said cable so that, in a working position of said connection piece, one leg of said bracket is positioned between the enlarged cable end and said connection piece, transverse to said cable, and another angled leg of said bracket engages said opening transversely to said opening and prevents said connection piece from being pried out by having its end face thrust against the inside of said continuous opening.

* * * * *